United States Patent [19]

Vaccaro

[11] Patent Number: 4,885,918

[45] Date of Patent: Dec. 12, 1989

[54] INFANT INCUBATOR MATTRESS POSITIONING ASSEMBLY

[75] Inventor: Robert K. Vaccaro, Philadelphia, Pa.

[73] Assignee: Air-Shields, Inc., Hatboro, Pa.

[21] Appl. No.: 269,129

[22] Filed: Nov. 9, 1988

[51] Int. Cl.[4] ..... A61G 11/00; A47C 31/00

[52] U.S. Cl. ..... 600/22; 5/11; 5/64; 182/141; 187/18; 248/421; 254/122; 269/322

[58] Field of Search ..... 5/11, 63, 64, 508, 60; 600/22; 269/322; 254/122, 124; 187/18; 182/141; 248/421

[56] References Cited

U.S. PATENT DOCUMENTS 1,986,035 1/1935 Wells ..... 254/122
3,292,902 12/1966 Lynch ..... 254/122

FOREIGN PATENT DOCUMENTS 0891094 12/1981 U.S.S.R. ..... 269/322

OTHER PUBLICATIONS

Operator's Manual for Isolette® Infant Incubator Model No. C100-1 and 1E, 1983, Trade Brochures from "Air Shields Co.", 330 Jacksonville Rd., Hatboro, Pa. 19040.

"Beyond the Double Wall . . .", Trade Brochures from Air Shields Co., 330 Jacksonville Rd., Hatboro, Pa. 19040.

"In the Isolette® Infant Incubator Tradition . . .", Trade Brochures from Air Shields Co., 330 Jacksonville Rd., Hatboro, Pa. 19040.

"Baby Your Budget", Trade Brochures from Air Shields Co., 330 Jacksonville Rd., Hatboro, Pa. 19040.

*Primary Examiner*—Alexander Grosz
*Attorney, Agent, or Firm*—Ratner & Prestia

[57] ABSTRACT

An infant incubator mattress positioning assembly having a pair of lift mechanisms spaced apart on the deck of the incubator. Each lift mechanism includes a scissor linkage which is operated by a lead screw mechanism. The mattress tray, positioned on the free ends of the links of the scissor linkages, is moved by turning a crank in the lead screw mechanism of each lift mechanism.

20 Claims, 3 Drawing Sheets

INFANT INCUBATOR MATTRESS POSITIONING ASSEMBLY

TECHNICAL FIELD

The present invention relates, in general, to lift mechanisms and, in particular, to apparatus for lifting and tilting an infant incubator mattress.

BACKGROUND ART

Infant incubators are arranged so that the mattress upon which the infant lies can be tilted for certain medical procedures and conditions and lifted to permit placement of an X-ray cassette under the mattress tray without disturbing the baby. In some incubators, mattress tilt or lift is accomplished by simple lever mechanisms with positive stops at one or two positions. Such lever mechanisms are difficult to operate in a smooth manner because of the positive stops. When the mattress nears the positive stop position, it can undergo a sudden, rapid, small displacement as the stopping mechanism locks in place. This movement can startle an infant on the mattress. Another disadvantage of such lever mechanisms is that the mattress can be positioned only at the preset stops.

Other infant incubators have somewhat complex mechanisms to provide a continuously variable mattress tilt or lift. Typically, these mechanisms employ long lead screws. Among the drawbacks of these mechanisms is that they are difficult to clean which must be done on a regular basis because they are located inside the incubator environment. The difficulty in cleaning comes about because of the extended length of the threaded profile of the lead screw and it is usually in an area that is difficult to access.

Another shortcoming of some lead screw mechanisms currently in use is that the mechanical advantage varies from one end of the stroke to the other end, whereby there is a large rise of the mattress for each crank revolution at one end of the stroke and a small rise for each crank revolution at the other end of the stroke. This results in a high torque requirement on the input crank at one end of the stroke or an inordinate number of turns required on the crank at the other end of the stroke or both.

Other shortcomings of incubator mattress lift arrangements in use at the present time which employ lead screw mechanisms are high cost and complicated linkage design.

DISCLOSURE OF THE INVENTION

A preferred embodiment of an infant incubator mattress positioning assembly, constructed in accordance with the present invention, includes a support structure and a pair of lift mechanisms positioned on the support structure and disposed parallel to each other. Each lift mechanism includes a scissor linkage having a pair of links attached for relative pivotal movement in a plane. A first end of one of the links is attached to the support structure for pivotal movement of this link relative to the support structure. Each lift mechanism also includes a lead screw mechanism having (a) a stationary member attached to the support structure and having a through-bore aligned with the plane of pivotal movement of the scissor linkage, (b) a movable member to which a first end of the second link is attached for pivotal movement of this link relative to the movable member and having a threaded bore aligned axially with the through-bore in the stationary member, and (c) a crank extending through the through-bore in the stationary member and having a threaded length in engagement with the threaded bore in the movable member. The crank rotates freely in the through-bore in the stationary member but is restrained from axial movement relative to the stationary member. The infant incubator mattress positioning assembly also includes a mattress support which is positioned on the free ends of the links of the two scissor linkages.

With two lift mechanisms included in the preferred embodiment of the present invention, two directions of tilt of the mattress are provided. In a second preferred embodiment of the present invention, only one tilt mechanism is provided with the other end of the mattress anchored to the support structure, so that only one direction of tilt is provided. If the reverse tilt condition is desired, the infant is simply turned around.

BEST MODE OF CARRYING OUT THE INVENTION

Figure 3:
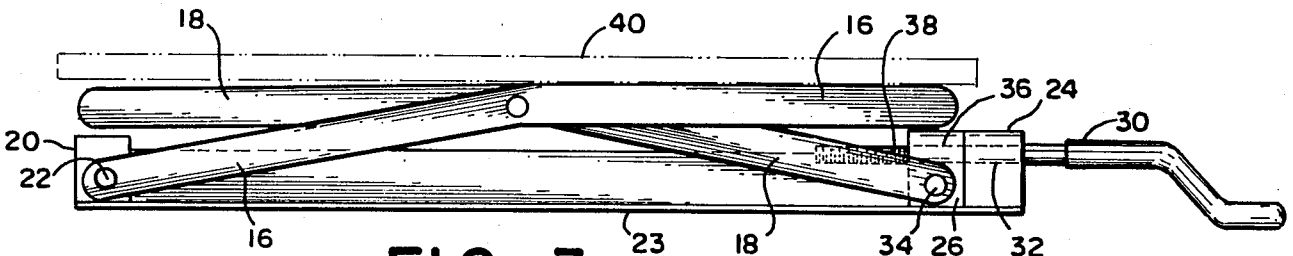
FIG. 3 is a side view of one of the lift mechanisms of the mattress positioning assembly of FIGS. 1 and 2 in its collapsed position.
Figure 4:
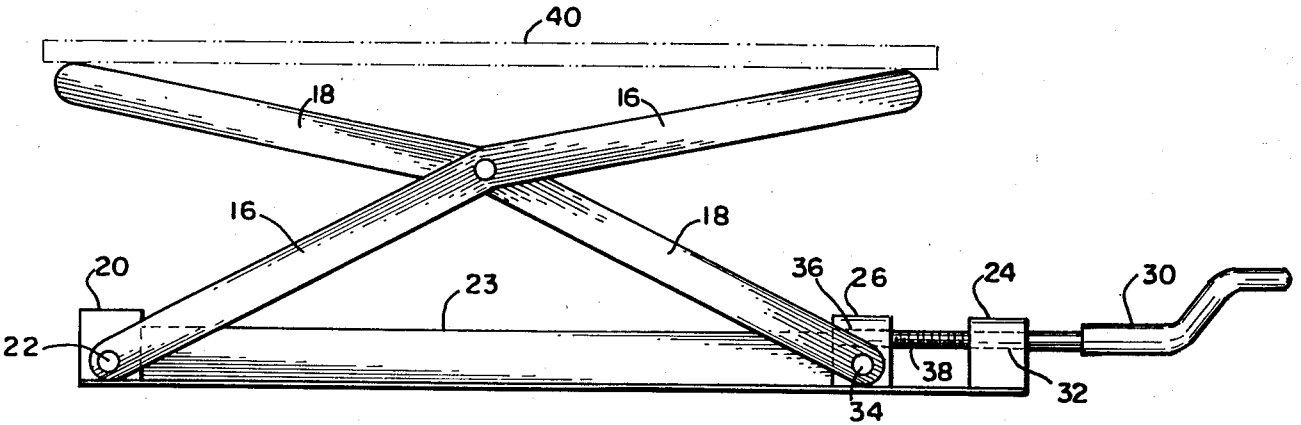
FIG. 4 is a side view, similar to FIG. 3, with the lift mechanism in a raised position.
Figure 5:
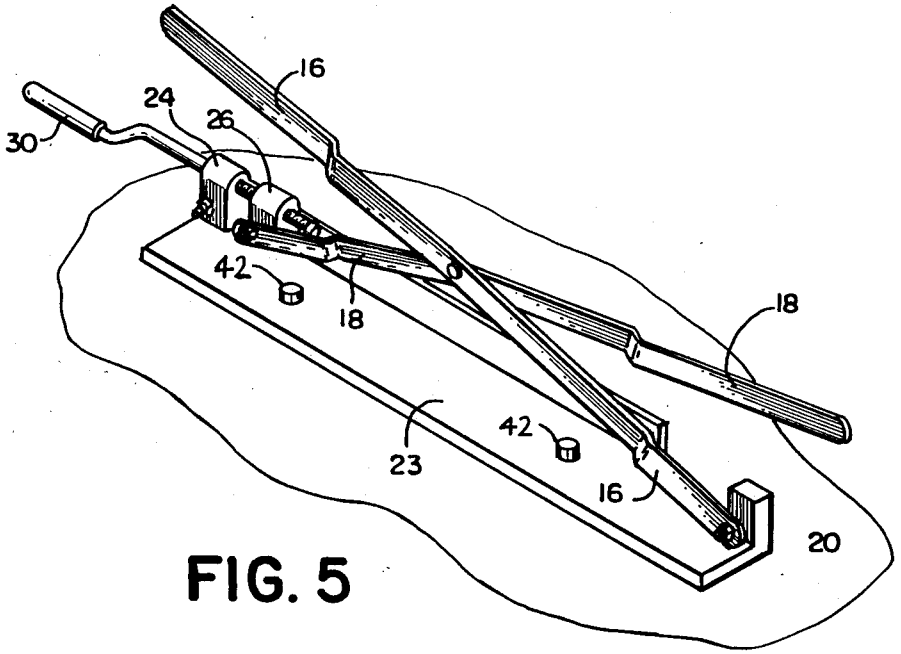
FIG. 5 is a perspective view of one of the lift mechanisms of the mattress positioning assembly of FIGS. 1 and 2.

Referring to the drawings, an infant incubator mattress positioning assembly, constructed in accordance with the present invention, includes a support structure 10, namely the deck of an incubator, and first and second lift mechanisms 12 and 14 positioned on the deck and disposed parallel to each other. FIGS. 3 and 4 show the details of lift mechanism 12 on an enlarged scale. In the preferred embodiment of the invention which is described and illustrated, lift mechanism 14 is a mirror image of lift mechanism 12, so that the description of the details of lift mechanism 12 is applicable also to lift mechanism 14.

Lift mechanism 12 includes a scissor linkage having first and second links 16 and 18 attached for relative pivotal movement in a first plane. One end of link 16 is attached to deck 10 for pivotal movement of link 16 relative to deck 10. Such attachment of link 16 to deck 10 is effected by means of a block 20 attached to deck 10 and a pivot pin 22 extending between block 20 and link 16, whereby link 16 is pivotable relative to block 20 in the pivot plane of links 16 and 18. In particular, block 20 is attached to a mounting member, in the form of a bracket 23, which, in turn, is attached to deck 10.

Lift mechanism 12 also includes a lead screw mechanism composed of a stationary block 24, a movable block 26, and a crank 30. Stationary block 24 is attached to deck 10 on a line from block 20 which extends along the pivot plane of links 16 and 18. Stationary block 24 has a through-bore 32 extending along the pivot plane of links 16 and 18 and is attached to angle bracket 23.

One end of link 18 is attached to movable block 26 by means of a pin 34 for pivotal movement of link 18 relative to movable block 26. A threaded bore 36, shown as a through-bore, is aligned axially with through-bore 32 in block 24 and extends through movable block 26.

Crank 30 extends through through-bore 32 in block 24 and has a threaded length 38 in engagement with threaded through-bore 36 in block 26. Crank 30 rotates freely within through-bore 32 but is restrained from axial movement relative to block 24.

An infant incubator mattress positioning assembly, constructed in accordance with the present invention, further includes a mattress tray 40, one end of which rests freely on the second ends of links 16 and 18. A mattress upon which an infant rests is positioned on mattress tray 40.

As indicated above, lift mechanism 14 is indentical to lift mechanism 12 and includes a scissor linkage having a pair of links attached for relative pivotal movement in a plane parallel to the plane of pivotal movement of links 16 and 18. Lift mechanism 14 also includes a lead screw mechanism to which the scissor linkage is attached. The other end of mattress tray 40 rests freely on the free ends of the links of this scissor linkage.

In the operation of the infant incubator mattress positioning assembly shown in the drawings, the cranks are operated individually to raise or lower the ends of mattress tray 40 to the same height, whereby the mattress tray is level, or to different heights, whereby the mattress tray is tilted. Considering lift mechanism 12, as crank 30 is turned, the threaded engagement between threaded length 38 at the end of the crank and threaded through-bore 36 extending through movable block 26 causes block 26 to slide on the horizontal surface of bracket 23 along a line extending between block 24 and block 20. The direction of movement of block 26 is determined by the direction of turning of crank 30.

Movement of block 26 causes link 18 to pivot about pin 34 causing the height of the opposite end of link 18 to change. At the same time, link 16 pivots about pin 22 causing a corresponding change in the height of the opposite end of link 16. The ends of links 16 and 18, upon which mattress tray 40 freely rests, move along grooves extending from front to rear in the bottom surface of the mattress tray as the height of these ends of the links changes. Comparing FIG. 3, which shows lift mechanism 12 in its collapsed position, and FIG. 4, which shows lift mechanism 12 in a raised position, when lift mechanism 12 is in a raised position and mattress tray 40 is raised, the mattress tray translates horizontally slightly toward the rear of the incubator. This results from the asymmetric arrangement of lift mechanism 12 with an end of link 16 which is fixed against linear movement and an end of link 18 which moves with movable block 26.

This arrangement, however, permits use of a relatively short lead screw and one which is easily accessible because it is near the front of the incubator. In addition, the mechanical advantage is generally uniform from one end of the stroke to the other end. Because the lead screw is short, movable block 26 can be guided by crank 30 and does not require a separate track.

Mattress tray 40 is restrained from substantial horizontal movement while in the raised position by the incubator hood in the usual manner. When the mattress tray is in its lower position, it can be moved horizontally and removed from the incubator.

As already explained, stationary blocks 20 and 24 are attached to bracket 23 and movable block 26 slides along bracket 23. This permits removal of the entire lift mechanism by simply releasing the means by which bracket 23 is attached to deck 10 which, as shown in the drawings, include a pair of screws 42.

In the preferred embodiment of the invention, each of the links of the scissor linkages is shaped with an obtuse angle in its pivot plane at their common pivot points to locate these common pivot points as high as possible above the other pivot points in the collapsed positions of the linkages. This arrangement avoids high start-up torque at the cranks. Also, for the links illustrated in the drawings, they are attached to the sides of blocks 20 and 26 but are bent so that the pivot planes are centered on these blocks and contain the axes of through-bore 32 and threaded through-bore 36.

The foregoing has set forth exemplary and preferred embodiments of the present invention. It will be understood, however, that various alternatives will occur to those of ordinary skill in the art without departure from the spirit and scope of the present invention.

What is claimed:

1. An infant incubator mattress positioning assembly comprising:

a deck within an infant incubator;

a first scissor linkage having first and second links attached for relative pivotal movement in a first plane;

a second scissor linkage having third and fourth links attached for relative pivotal movement in a second plane parallel to said first plane;

first attaching means for attaching a first end of said first link to said deck for pivotal movement of said first link relative to said deck;

second attaching means for attaching a first end of said third link to said deck for pivotal movement of said third link relative to said deck;

a first lead screw mechanism including:

(a) a first stationary member attached to said deck and having a first through-bore aligned with said first plane, (b) a first movable member to which a first end of said second link is attached for pivotal movement of said second link relative to said first movable member and having a first threaded bore aligned axially with said first through-bore, and (c) a first crank extending through said first through-bore and having a threaded length in engagement with said first threaded bore, said first crank freely rotatable within said first through-bore and restrained from axial movement relative to said first stationary member;

a second lead screw mechanism including:

(a) a second stationary member attached to said deck and having a second through-bore aligned with said second plane, (b) a second movable member to which a first end of said fourth link is attached for pivotal movement of said fourth link relative to said second movable member and having a second threaded bore aligned axially with said second through-bore, and (c) a second crank extending through said second through-bore and having a threaded length in engagement with said second threaded bore, said second crank freely rotatable within said second through-bore and restrained from axial movement relative to said second stationary member;

and a mattress support positioned on the second ends of said first, said second, said third and said fourth links.

2. An infant incubator mattress positioning assembly according to claim 1 wherein each of said links is shaped with an obtuse angle in its pivot plane at the point of attachment with the other link.

3. An infant incubator mattress positioning assembly comprising:

a deck within an infant incubator;

a first scissor linkage having first and second links attached for relative pivotal movement in a first plane;

a second scissor linkage having third and fourth links attached for relative pivotal movement in a second plane parallel to said first plane;

a first stationary block fixed in place relative to said deck;

means for attaching a first end of said first link to said first stationary block for pivotal movement of said first link relative to said first stationary block in said first plane;

a second stationary block fixed in place relative to said deck on a first line from said first stationary block which extends along said first plane, said second stationary block having a first through-bore extending along said first plane;

a first sliding block movable along said first line and having a first threaded bore aligned with said first through-bore in said second stationary block;

means for attaching a first end of said second link to said first sliding block for pivotal movement of said second link relative to said first sliding block in said first plane;

a first crank extending through said first through-bore and having a threaded length in engagement with said first threaded bore, said first crank freely rotatable within said first through-bore and restrained from axial movement relative to said second stationary block;

a third stationary block fixed in a place relative to said deck;

means for attaching a first end of said third link to said third stationary block for pivotal movement of said third link relative to said third stationary block in said second plane;

a fourth stationary block fixed in place relative to said deck on a second line from said third stationary block which extends along said second plane, said fourth stationary block having a second through-bore extending along said second plane;

a second sliding block movable along said second line and having a second threaded bore aligned with said second through-bore in said fourth stationary block;

means for attaching a first end of said fourth link to said second sliding block for pivotal movement of said fourth link relative to said second sliding block in said second plane;

a second crank extending through said second through-bore and having a threaded length in engagement with said second threaded bore, said second crank freely rotatable within said second through-bore and restrained from axial movement relative to said fourth stationary block;

and a mattress support resting freely on the second ends of said first, said second, said third and said fourth links.

4. An infant incubator mattress positioning assembly according to claim 3 wherein each of said links is shaped with an obtuse angle in its pivot plane at the point of attachment with the other link.

5. An infant incubator mattress positioning assembly according to claim 3 further including: (a) a first mounting member attached to said deck and to which said first and said second stationary blocks are attached and along which said first sliding block moves, and (b) a second mounting member attached to said deck and to which said third and said fourth stationary blocks are attached and along which said second sliding block moves.

6. An infant incubator mattress positioning assembly according to claim 5 wherein said first and said second threaded bores are threaded through-bores.

7. An infant incubator mattress positioning assembly according to claim 6 wherein each of said links is shaped with an obtuse angle in its pivot plane at the point of attachment with the other link.

8. An infant incubator mattress positioning assembly according to claim 5 wherein each of said links is shaped with an obtuse angle in its pivot plane at the point of attachment with the other link.

9. An infant incubator mattress positioning assembly according to claim 8 wherein: (a) said first link is attached to a side of said first stationary block, (b) said second link is attached to a side of said first sliding block, (c) said third link is attached to a side of said third stationary block, (d) said fourth link is attached to a side of said second sliding block, and (e) each of said links is bent so that said first plane contains the axes of said first through-bore and said first threaded bore and said second plane contains the axes of said second through-bore and said second threaded bore.

10. An infant incubator mattress positioning assembly comprising:

a deck within an infant incubator;

a scissor linkage having first and second links attached for relative pivotal movement in a plane;

a first stationary block fixed in place relative to said deck;

means for attaching a first end of said first link to said first stationary block for pivotal movement of said first link relative to said first stationary block in said plane;

a second stationary block fixed in place relative to said deck on a line from said first stationary block which extends along said plane, said second stationary block having a through-bore extending along said plane;

a sliding block movable along said line and having a threaded bore aligned with said through-bore in said second stationary block;

means for attaching a first end of said second link to said sliding block for pivotal movement of said second link relative to said sliding block in said plane;

a crank extending through said through-bore and having a threaded length in engagement with said threaded bore, said crank freely rotatable within said through-bore and restrained from axial movement relative to said second stationary block;

and a mattress support resting freely on the second ends of said first and said second links.

11. An infant incubator mattress positioning assembly according to claim 10 further including a mounting member attached to said deck and to which said first and said second stationary blocks are attached and along which said sliding block moves.

12. An infant incubator mattress positioning assembly according to claim 11 wherein said threaded bore is a threaded through-bore.

13. An infant incubator mattress positioning assembly according to claim 12 wherein each of said links is shaped with an obtuse angle in its pivot plane at the point of attachment with the other link.

14. An infant incubator mattress positioning assembly according to claim 11 wherein each of said links is shaped with an obtuse angle in its pivot plane at the point of attachment with the other link.

15. An infant incubator mattress positioning assembly according to claim 14 wherein: (a) said first link is attached to a side of said first stationary block, (b) said second link is attached to a side of said sliding block, and (c) each of said links is bent so that said plane contains the axes of said through-bore and said threaded bore.

16. An infant incubator mattress positioning assembly comprising:

a deck within an infant incubator;

a scissor linkage having first and second links attached for relative pivotal movement in a plane;

attaching means for attaching a first end of said first link to said deck for pivotal movement of said first link relative to said deck;

a lead screw mechanism including:

(a) a stationary member attached to said deck on a line from said attaching means which extends along said plane and having a through-bore aligned with said plane, (b) a movable member to which a first end of said second link is attached for pivotal movement of said second link relative to said movable member and having a threaded bore aligned axially with said through-bore, and (c) a crank extending through said through-bore and having a threaded length in enagement with said threaded bore, said crank freely rotatable within said through-bore and restrained from axial movement relative to said stationary member;

and a mattress support positioned on the second ends of said first and said second links.

17. An infant incubator mattress positioning assembly according to claim 16 wherein each of said links is shaped with an obtuse angle in its pivot plane at the point of attachment with the other link.

18. An infant incubator mattress positioning assembly according to claim 17 wherein said threaded bore is a threaded through-bore.

19. An infant incubator having a mattress positioning assembly supported on the deck of the incubator within the hood of the incubator and characterized by:

a first scissor linkage having first and second links attached for relative pivotal movement in a first plane;

a second scissor linkage having third and fourth links attached for relative pivotal movement in a second plane parallel to said first plane;

means for attaching a first end of said first link to said deck for pivotal movement of said first link relative to said deck;

means for attaching a first end of said third link to said deck for pivotal movement of said third link relative to said deck;

a first lead screw mechanism including:

(a) a first stationary member having a first through-bore aligned with said first plane, (b) means for attaching said first stationary member to said deck, (c) a first movable member to which a first end of said second link is attached for pivotal movement of said second link relative to said first movable member and having a first threaded bore aligned axially with said first through-bore, and (d) a first crank extending through said first through-bore and having a threaded length in engagement with said first threaded bore, said first crank freely rotatable within said first through-bore and restrained from axial movement relative to said first stationary member;

a second lead screw mechanism including:

(a) a second stationary member having a second through-bore aligned with said second plane, (b) means for attaching said second stationary member to said deck, (c) a second movable member to which a first end of said fourth link is attached for pivotal movement of said fourth link relative to said second movable member and having a second threaded bore aligned axially with said second through-bore, and (d) a second crank extending through said second through-bore and having a threaded length in engagement with said second threaded bore, said second crank freely rotatable within said second through-bore and restrained from axial movement relative to said second stationary member;

and a mattress support positioned on the second ends of said first, said second, said third and said fourth links.

20. An infant incubator mattress positioning assembly according to claim 19 wherein each of said links is shaped with an obtuse angle in its pivot plane at the point of attachment with the other link.

* * * * *

UNITED STATES PATENT AND TRADEMARK OFFICE

CERTIFICATE OF CORRECTION

PATENT NO. : 4,885,918

DATED : December 12, 1989

INVENTOR(S) : Robert K. Vaccaro

Figure 1:
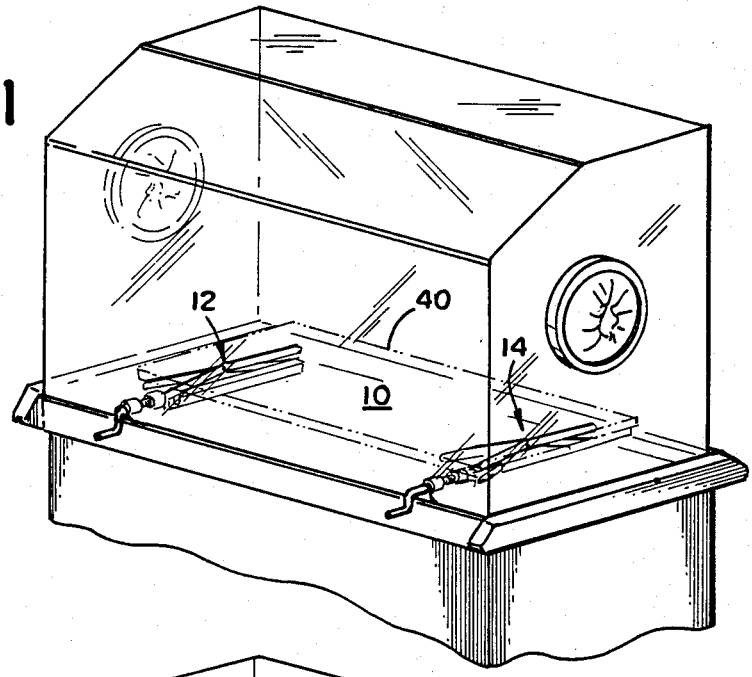
FIG. 1 is a perspective view of an infant incubator with a mattress positioning assembly, constructed in accordance with the present invention, in its collapsed position.
Figure 2:
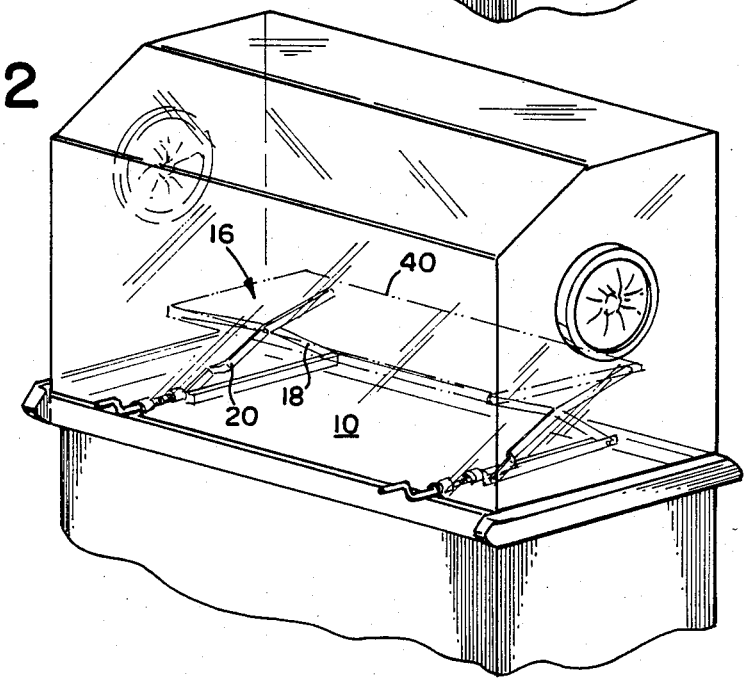
FIG. 2 is a perspective view, similar to FIG. 1, with the mattress positioning assembly in a raised position.

It is certified that error appears in the above—identified patent and that said Letters Patent is hereby corrected as shown below:

In Figure 2, change reference numeral "16" to --12--;

change reference numeral "18" to --16--;

change reference numeral "20" to --18--.

Signed and Sealed this

Twenty-sixth Day of February, 1991

*Attest:*

HARRY F. MANBECK, JR.

*Attesting Officer*

*Commissioner of Patents and Trademarks*